US008419092B2

(12) United States Patent
Zimmermann et al.

(10) Patent No.: US 8,419,092 B2
(45) Date of Patent: Apr. 16, 2013

(54) FOOD HANDLING DEVICE

(76) Inventors: Eric Zimmermann, Astoria, NY (US); Daniel J. Ferrara, Jr., Levittown, NY (US)

( * ) Notice: Subject to any disclaimer, the term of this patent is extended or adjusted under 35 U.S.C. 154(b) by 126 days.

(21) Appl. No.: 12/682,890

(22) Filed: Apr. 13, 2010

(65) Prior Publication Data

US 2011/0041349 A1 Feb. 24, 2011

Related U.S. Application Data

(63) Continuation of application No. PCT/US2008/072711, filed on Aug. 8, 2008.

(60) Provisional application No. 60/935,393, filed on Aug. 10, 2007.

(51) Int. Cl.
*B65G 7/12* (2006.01)

(52) U.S. Cl.
USPC ..... 294/25; 2/16; 2/21

(58) Field of Classification Search ..... 294/1.3, 294/28, 33, 99.2, 176; 2/16, 21, 160, 163; 446/329, 26; 473/503, 205, 458; 482/44, 482/47, 48, 49
See application file for complete search history.

(56) References Cited

U.S. PATENT DOCUMENTS

| | | | | |
|---|---|---|---|---|
| 502,896 | A * | 8/1893 | Vine | 446/488 |
| 1,156,459 | A | 10/1915 | Brown | |
| 3,103,213 | A * | 9/1963 | Robinson | 124/88 |
| 3,501,191 | A | 3/1970 | Darr | |
| 3,593,803 | A * | 7/1971 | Ibach | 172/10 |
| 4,038,787 | A * | 8/1977 | Bianchi | 451/523 |
| 4,261,608 | A | 4/1981 | Bradshaw | |
| 4,675,914 | A * | 6/1987 | Mitchell | 2/161.1 |
| 4,728,130 | A | 3/1988 | Corzine | |
| 4,751,747 | A * | 6/1988 | Banks et al. | 2/21 |
| 4,867,246 | A * | 9/1989 | Kiger | 172/370 |
| 4,961,568 | A * | 10/1990 | Clark et al. | 482/48 |

(Continued)

FOREIGN PATENT DOCUMENTS

| | | |
|---|---|---|
| FR | 1369291 | 8/1964 |
| FR | 2786678 | 6/2000 |

(Continued)

OTHER PUBLICATIONS

*Supplementary European Search Report* dated Oct. 19, 2011, 6 pages.

(Continued)

*Primary Examiner* — Dean Kramer
*Assistant Examiner* — Stephen Vu
(74) *Attorney, Agent, or Firm* — Collard & Roe, P.C.

(57) ABSTRACT

An eating utensil design for providing comfortable control of certain food. A user of the utensil can grasp the utensil which has at least three digit elements for grasping food. An example of the three digit elements are in the form of three channeled compartments for receiving a person's fingers or digits. Any three fingers or digits can be used such as the thumb or the four other fingers. The most common implementation includes using the thumb in one channel, and the index finger and the middle finger in two opposing channels. Thus an eating utensil is provided that allows comfortable and efficient manipulation of food while shielding the fingers from sauces and that can be quickly and single-handedly grasped for use and released.

26 Claims, 11 Drawing Sheets

U.S. PATENT DOCUMENTS

| | | | | | |
|---|---|---|---|---|---|
| 5,359,840 | A | * | 11/1994 | Costar | 56/400.12 |
| 5,568,957 | A | * | 10/1996 | Haugs | 294/119.3 |
| 5,649,728 | A | | 7/1997 | Warthen | |
| 5,653,488 | A | | 8/1997 | Ordonez | |
| 5,661,853 | A | * | 9/1997 | Wilmot | 2/163 |
| 5,709,423 | A | | 1/1998 | Romero | |
| 5,749,097 | A | * | 5/1998 | Garrett-Roe | 2/21 |
| 5,848,928 | A | | 12/1998 | Wong | |
| 6,089,631 | A | | 7/2000 | Thurlow et al. | |
| 6,276,734 | B1 | | 8/2001 | Krieger | |
| 6,918,137 | B2 | * | 7/2005 | Fowler | 2/16 |
| 6,944,914 | B2 | * | 9/2005 | Tillim | 16/430 |
| 7,165,270 | B2 | | 1/2007 | DeYoung et al. | |
| 7,287,791 | B2 | | 10/2007 | Carolina | |
| 2003/0131393 | A1 | * | 7/2003 | Votolato | 2/16 |
| 2003/0190997 | A1 | * | 10/2003 | Siek | 482/47 |
| 2006/0249967 | A1 | | 11/2006 | Carolina | |

FOREIGN PATENT DOCUMENTS

| | | |
|---|---|---|
| JP | 62114016 | 7/1987 |
| JP | H02138651 | 11/1990 |
| JP | H08395 | 2/1996 |
| KR | 2019990037804 | 10/1999 |
| WO | WO 2006/046086 | 5/2006 |
| WO | WO 2007/117067 | 10/2007 |

OTHER PUBLICATIONS

Translation of FR278678 (FR278678 previously Submitted on Nov. 25, 2011).

Translation of FR1369291 (FR1369291 previously submitted on Nov. 25, 2011).

International Search Report for PCT/US2008/072711 Dated Feb. 26, 2009.

* cited by examiner

FOOD HANDLING DEVICE

CROSS REFERENCE TO RELATED APPLICATIONS

This application is a continuation application of PCT/US2008/72711 filed on Aug. 8, 2008, and hereby claims the benefit under 35 U.S.C. 120 of international application PCT/US2008/72711 filed on Aug. 8, 2008, and titled "Food Handling Device" wherein that application claims priority under 35 U.S.C. 119(e) from U.S. Provisional Application Ser. No. 60/935,393 filed on Aug. 10, 2007 wherein the disclosure of which is hereby incorporated herein by reference in its entirety.

BACKGROUND

This invention relates to a new type of eating utensil that enables users to comfortably manipulate food without the user's fingers coming into direct contact with the food. People often decide against eating foods such as chicken wings and barbequed pork ribs in order to avoid getting sauce on their hands and potentially their clothing. Even when conditions are acceptable for eating messy foods, people tend to avoid touching anything while their hands have sauce on them thereby precluding them from consuming beverages until they have finished eating the entire serving and have cleaned their hands. An additional benefit afforded by this device is the reduced likelihood of spreading disease causing viruses and bacteria. Thus, with this type of device there are also sanitation concerns that are addressed because now the user does not have direct contact with the food being handled except for directly eating the food instead of touching the food.

U.S. Pat. No. 5,709,423 to Romero discloses a food gripper utensil. This food gripper utensil does not contain more than two limbs. Other patents that may generally relate include U.S. Pat. No. 7,165,270 to DeYoung et al; U.S. Pat. No. 3,501,191 to L. Darr; U.S. Pat. No. 7,287,791 to Carolina; U.S. Pat. No. 4,728,130 to Oretti; and U.S. Pat. No. 6,276,734 to Krieger. U.S. Pat. No. 5,848,928 to Wong, U.S. Pat. No. 1,156,459 to Brown, U.S. Pat. No. 5,653,488 to Ordonez, and U.S. Pat. No. 5,649,728 to Warthen.

It is believed that the above art does not disclose a food handling device having at least three limbs and that is gripped along the center-line of the limbs of the utensil and is held by compression of the user's fingers against the limbs of the utensil which tend to flex into the open position.

SUMMARY

One embodiment of the invention relates to a food handing device comprising at least three limbs. The limbs comprise a first limb for receiving a first finger; a second limb for receiving a second finger; and a third limb for receiving a third finger. In this case while the term finger is used any type of digit such as a finger or a thumb can be used. In addition, there is at least one body section coupled to each of said first limb, said second limb, and said third limb said at least one body section forming at least one hinge for allowing at least one of said first limb, said second limb and said third limb to be movable about an axis formed on said body section. In this case, an optional but not required feature is that each limb can have at least one tooth.

Some of the benefits of this type device is that with three limbs, it offers greater stability for a user when that user is eating food. In addition, because there are three limbs, that user can then stand the device on its end such that the distal ends of the limbs opposite the body are used to support the device in an upstanding manner such as in the form of a tri-pod. This allows a user to easily insert his or her fingers into the open end of the device to grasp the gripping device and then pick it up.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Figure 1:
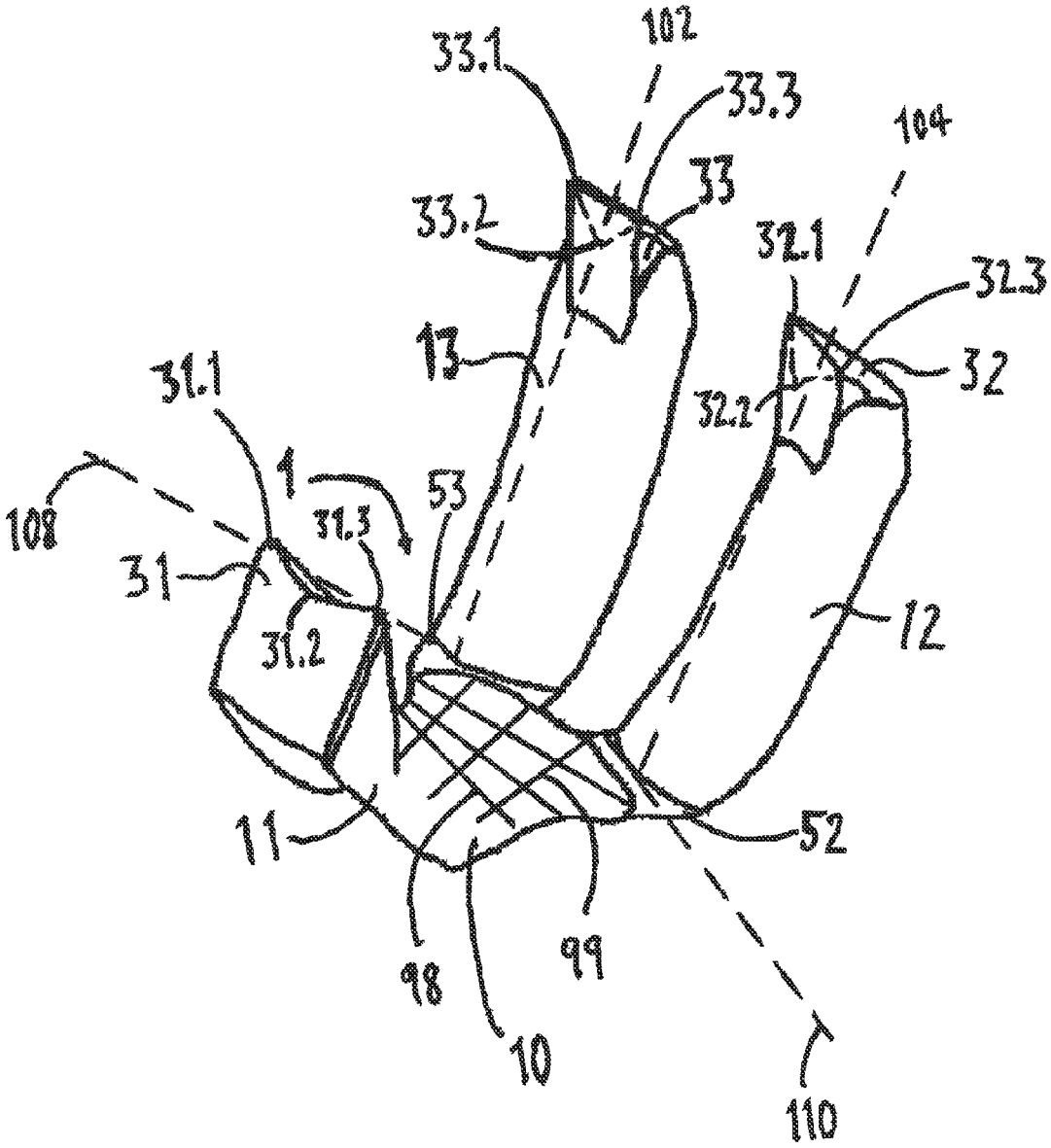
FIG. 1 is a perspective right-side view of a three-limbed version of the utensil constructed in accordance with the invention.

FIG. 1 is a perspective right-side top view of a three-limbed version of the device 1. The device includes a body section 10 which is coupled to first limb 11 in an integral manner. In addition, second limb 12 is coupled to body section via hinge 52, while third limb 13 is coupled to body section 10 via hinge 53. Hinges 52 and 53 can be in the form of any known hinge but in this example show living hinges. Living hinges are hinges that are formed from material that is usually integral with the two components that are hinged. In this case, these hinges 52 and 53 can also have a natural spring incorporated therein based upon the material properties of the living hinge. Therefore, when a user is not pressing down in limbs 11, 12 and 13, limbs 12 and 13 would naturally spring away from limb 11. First limb 11 has tooth 31 at its tip. Second limb 12 has tooth 32 formed at its tip. Third limb 13 has tooth 33 formed at its tip. These teeth can be in any shape but in this case, these teeth are shown ramp shaped. Alternatively, these teeth can be formed as concave having two prongs sticking out from each side.

For example, as shown in FIG. 1, tooth 31 has tooth points or tips 31.1 and 31.3 and recess point 31.2. Teeth 32 and 33 can be ramp shaped but also be formed as concave shaped teeth shown by the dashed lines. With this design, tooth 32 is formed in a concave manner or in a recessed "V" shape having tooth point 32.1 a recess point 32.2, and another tooth point 32.3. Tooth 33 can also optionally be formed with a tooth point 33.1 a recess point 32.2 and another tooth point 33.3. In addition, in this view, there are a plurality of reinforcing ribs 98 and 99 which essentially criss-cross each other and provide reinforcing support for the body section 10. In addition, as shown in this view, second limb 12 has a longitudinal axis 104 and a rotational axis 110 while third limb 113 has a longitudinal axis 102 and a rotational axis 108. Rotational axis 110 is transverse to longitudinal axis 104, while rotational axis 102 is transverse or normal to rotational axis 108. (See also FIGS. 9 and 10) In addition, while this embodiment shows a device having teeth, teeth in this case are optional and are not required for operation. Therefore, it is clear that this device and therefore the invention can also be implemented without the use of teeth (see dashed lines in FIG. 4 indicating an example of an embodiment with no teeth).

While the device can be made from various materials, the most feasible embodiment of the utensil can be made of plastic or other moldable material which is safe for contact with food as a limited use-product via conventional injection molding processes. However, other types of materials can be used such as cornstarch, cardboard, paper, wherein these materials can constitute a more environmentally friendly version. Other alternative materials such as rubber or other types of materials can be used such as a composite material or metal as well. Thus, while the device may be made inexpensively so that it is disposeable, a non-disposable version may be stamped, folded or otherwise forged of metal.

An edible version of this product can be made of food matter such as that derived from fibrous vegetables and molded in accordance with this invention and solidified with syrup or other coating such as that derived from oats or honey.

Figure 2:
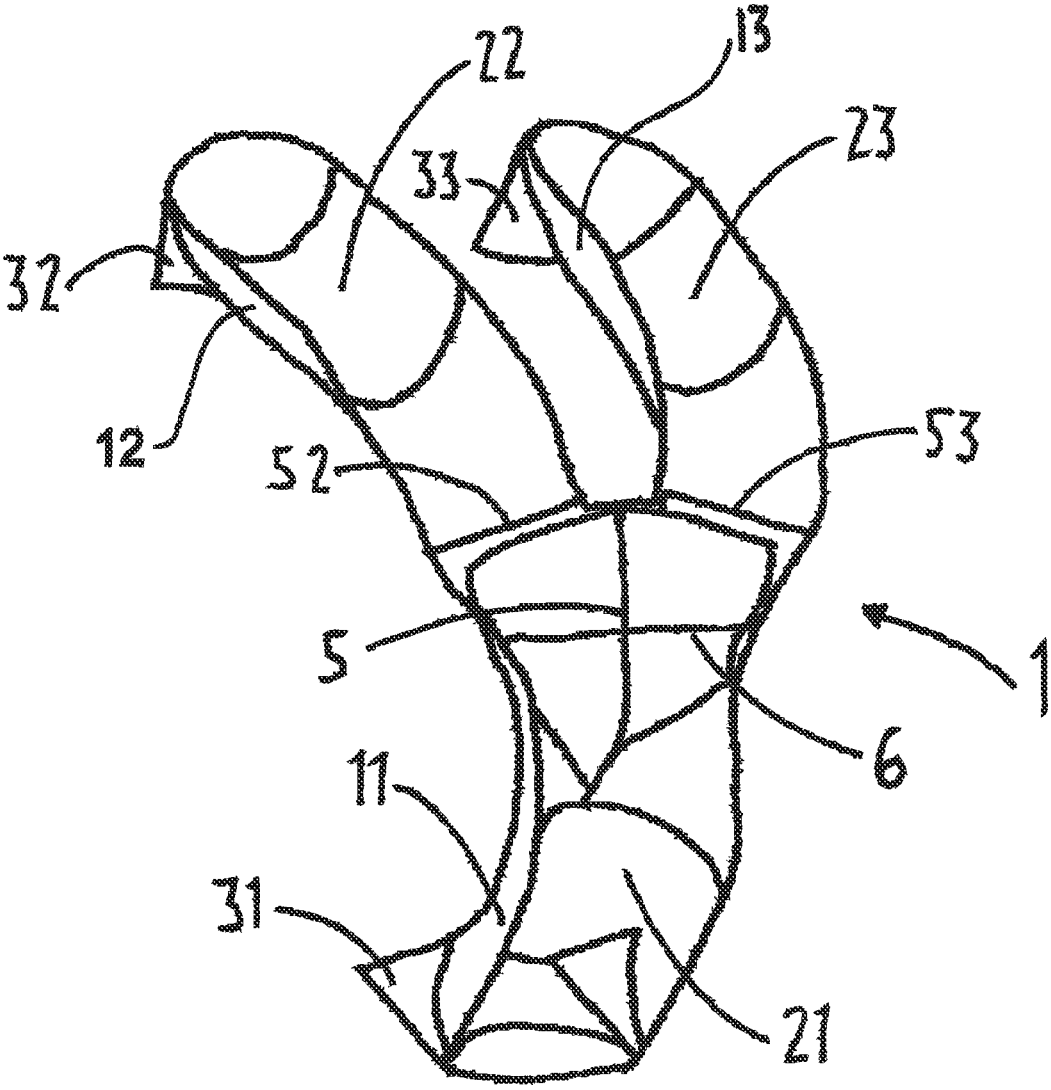
FIG. 2 is a perspective rear view of the utensil of FIG. 1 in the fully open position.

FIG. 2 is a perspective, rear view of the utensil of FIG. 1 in the fully open position. This view shows channels which are designed to receive a user's digits Each of these limbs form backside channels allowing a user to insert his or her fingers or digits into these channels to control the manipulation of these limbs 11, 12 and 13. This perspective is oriented in such a way so as to be grasped by the viewer with his or her right hand such that the thumb would rest in first finger channel 21 on first limb 11, the index finger would rest in second finger channel 22 on second limb 12, and the middle finger of the right hand would rest in third finger channel 23 on third limb 13. Second limb 12 meets the body of first limb 11 at second limb hinge 52. Third limb 13 meets the body of first limb 11 at third limb hinge 53. Channels 21, 22 and 23 each have two sides and a closed end at the end of the limb opposite the body section 10.

Figure 3:
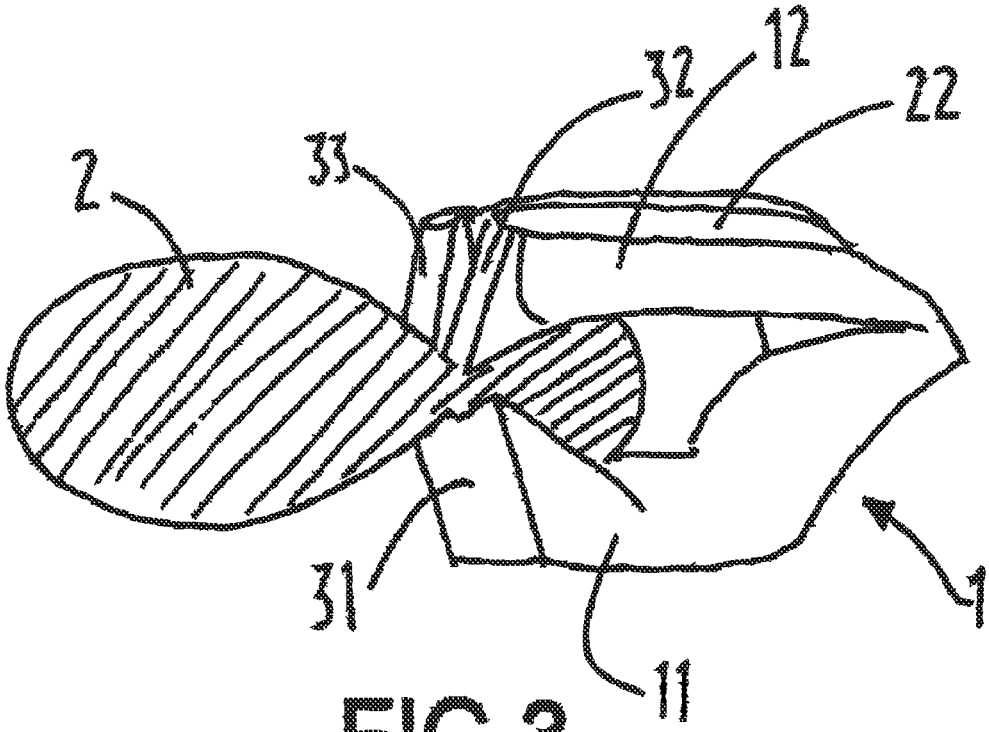
FIG. 3 is a perspective front right-side view of the utensil of FIGS. 1 and 2 compressed to grasp a chicken leg.

FIG. 3 is a perspective front right-side view of the utensil of FIGS. 1 and 2 compressed to grasp food 2. The user's hand is implied by the compression on the utensil but is not shown in this figure so as not to obscure the view of the utensil. The food item in this drawing is a chicken leg. This view shows the utensil in such a way that the user has grasped the chicken leg such that the limb teeth 31, 32, and 33 are behind the condile or end of the bone at the point of smallest bone diameter so as to minimize the potential for slippage.

Figure 4:
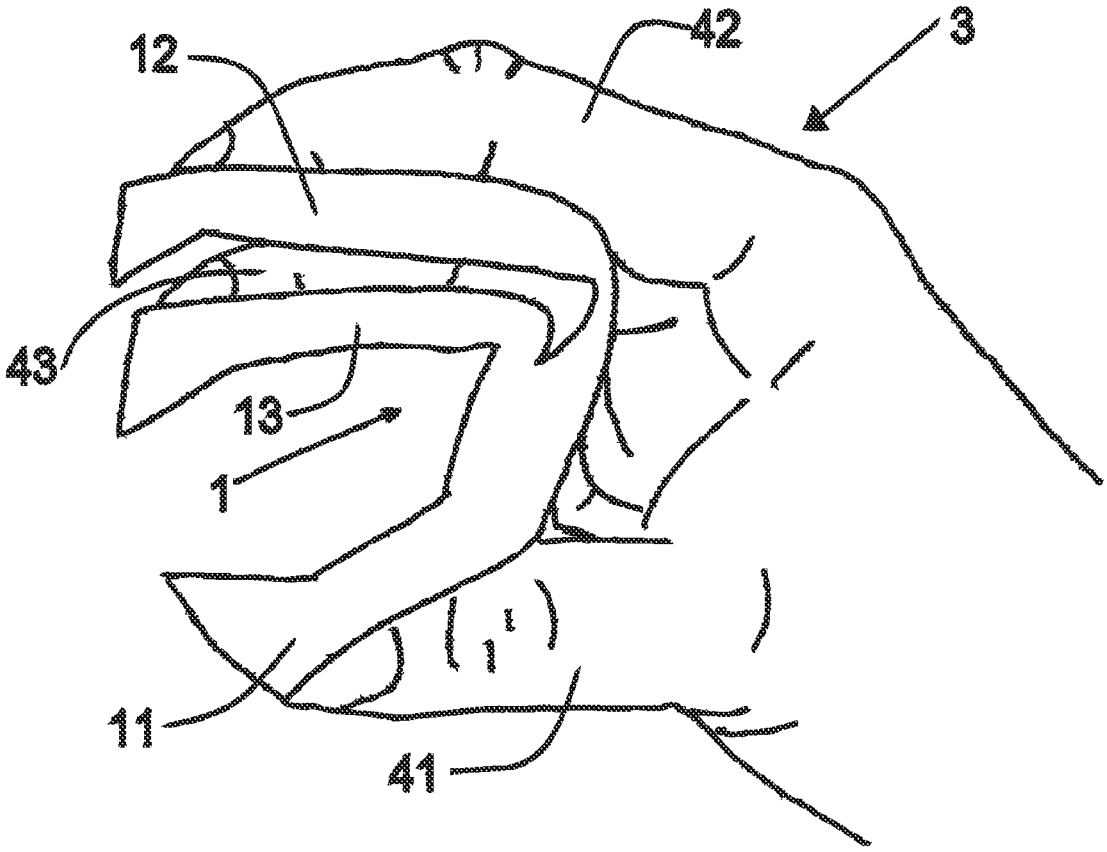
FIG. 4 is a perspective right side view of the utensil of FIGS. 1, 2, and 3 in hand and slightly compressed.

FIG. 4 is a perspective right side view of the utensil of FIGS. 1, 2, and 3 with the user's right hand shown and slightly compressed. Utensil 1 is held by hand 3 such that thumb 41 is in finger channel 21, second finger 42 is in finger channel 22 of utensil limb 12, and third finger 43 is in finger channel 23 of utensil limb 13. This view also shows additional hinges 120 and 130 which are used to create additional bend points in limbs 12 and 13 respectively.

Figure 5:
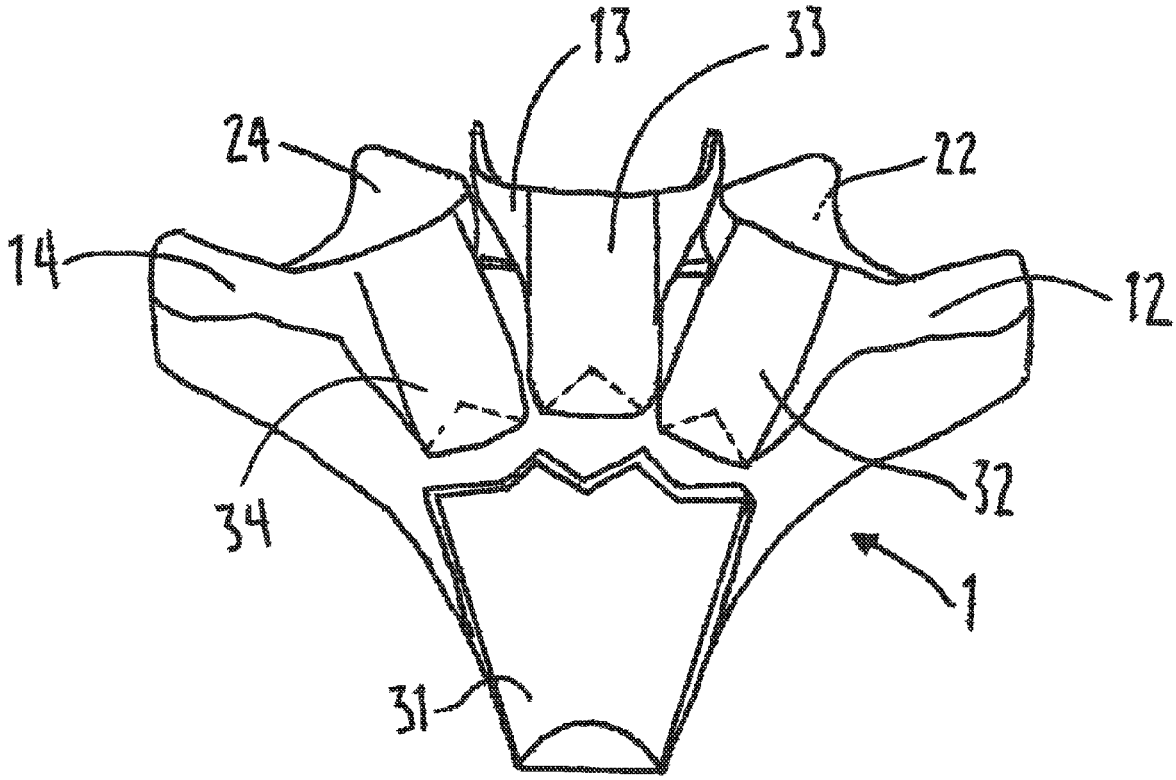
FIG. 5 is a front view of a four-limbed version of the utensil constructed in accordance with the invention in a slightly uncompressed position.

FIG. 5 is a front view of a four-limbed version of the utensil constructed in accordance with the invention in a slightly uncompressed position. This version of the utensil has all the elements of the three-limbed version of figures one through four but includes finger channel 24 of fourth-limb 14 with tooth 34 at it's tip.

Figure 6:
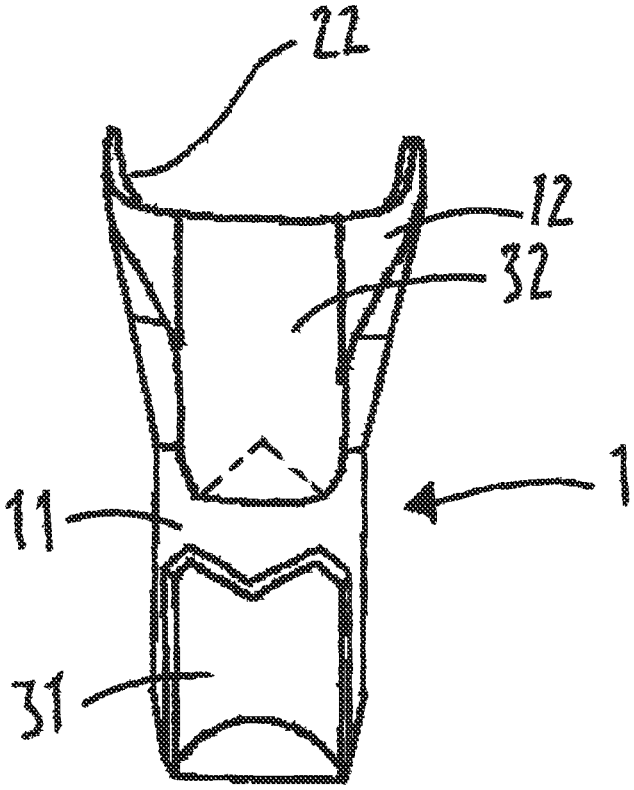
FIG. 6 is a front view of a two-limbed version of the utensil constructed in accordance with the invention in a slightly open position.

FIG. 6 is a front view of a two-limbed version of the utensil constructed in accordance with the invention in a slightly open position. This version only has first-limb 11 and second-limb 12 with the aforementioned associated teeth and finger channels. Second-limb 12 can be widened to accommodate more than one finger.

Figure 7:
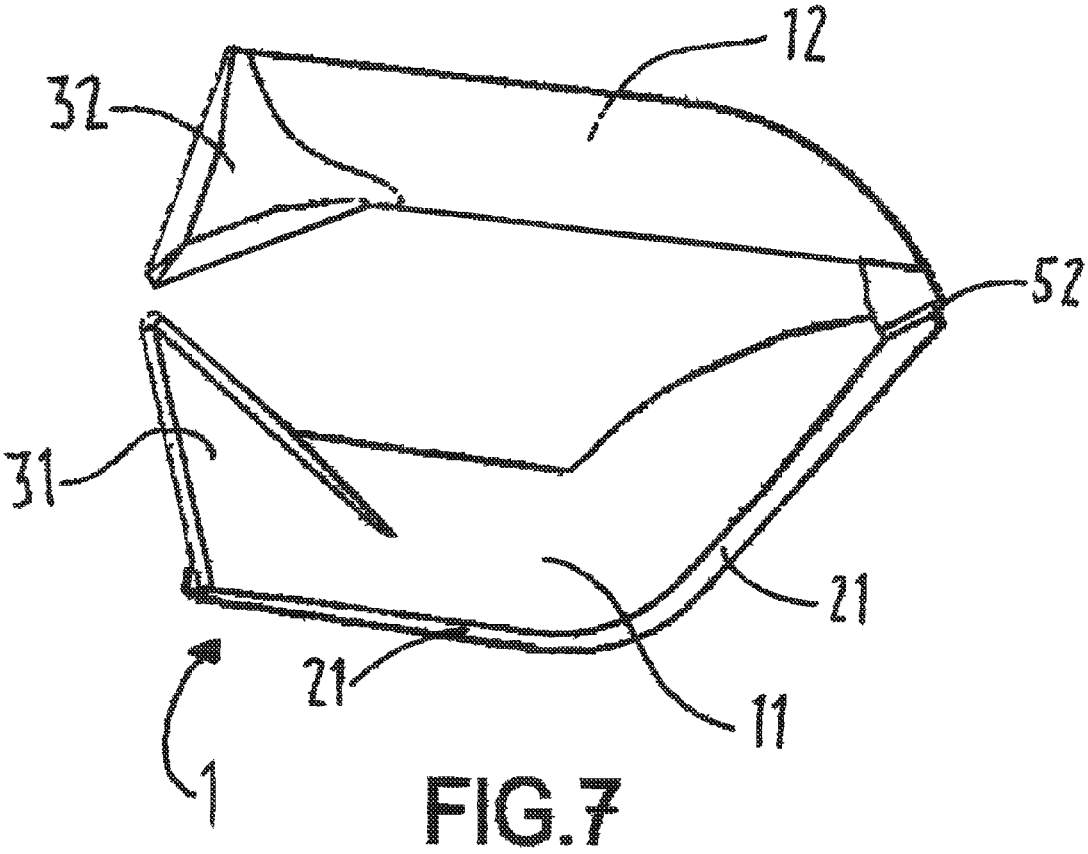
FIG. 7 is a side view of a two-limbed version of the utensil in a slightly open position.

FIG. 7 is a side view of a two-limbed version of the utensil of FIG. 6 in a slightly open position. This view affords perspective of second-limb hinge 52 which would be the only hinge of this embodiment. Although the first limb is shown with a bend for ergonomics and comfort, any limb can be either straight or curved.

Figure 8:
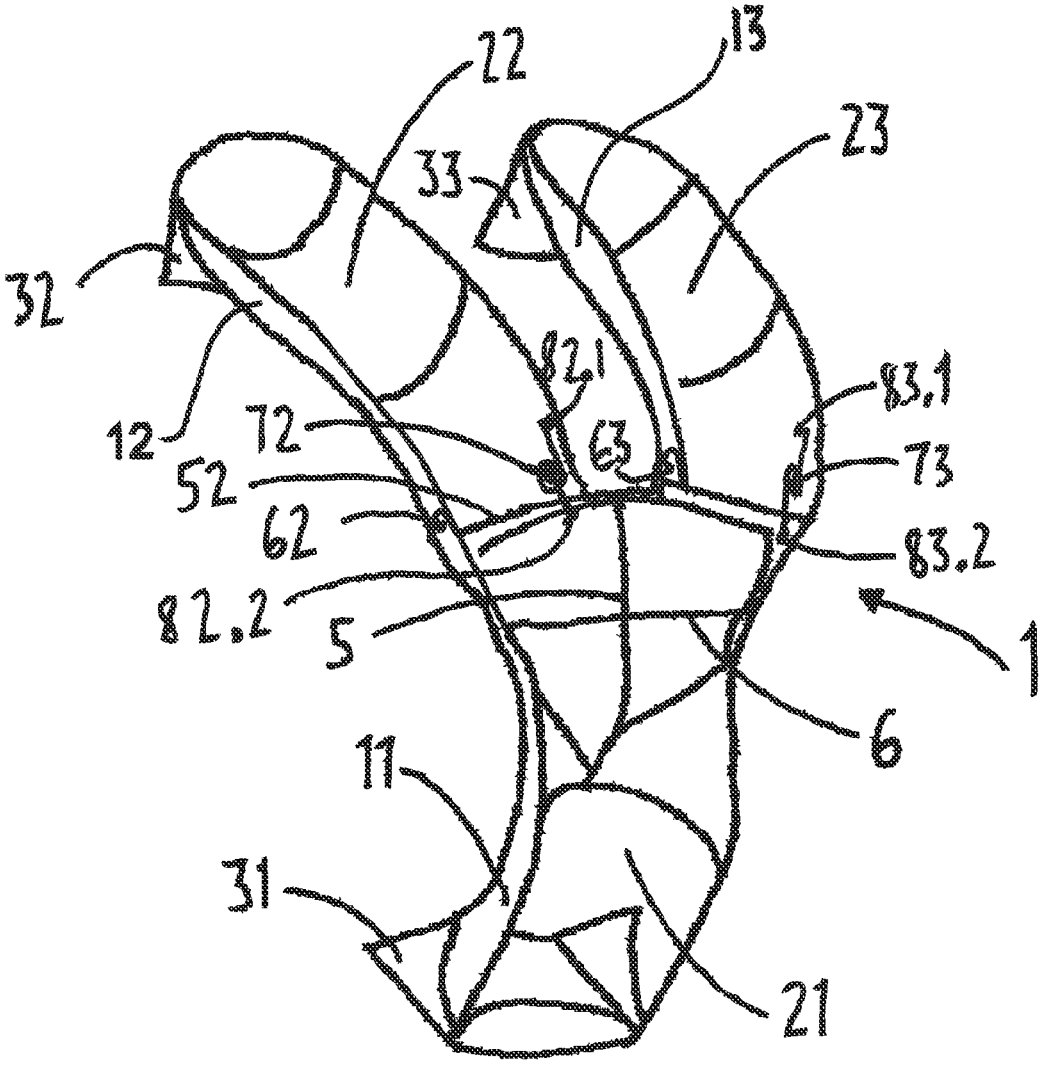
FIG. 8 is a perspective view of another embodiment.

FIG. 8 is a side view of a three limbed embodiment which has coil springs which are used as hinges. For example, there are two coil springs 72 and 73 wherein the first coil spring 72 is for second limb 12 and the second coil spring is for third limb 13. Each of these coil springs is fixed to their respective limbs via retainer pins. For example, spring 72 is secured at one end via second limb channel spring retainer pin 82.1, and at the opposite end via second limb body spring retainer pin 82.2. Spring 73 is secured at one end via third limb channel spring retainer pin 83.1 and at the opposite end via third limb body spring retainer pin 83.2. With this embodiment, limb 12 is coupled to body section 10 via a rotational hinge 62 while limb 13 is coupled to body section 10 via rotational hinge 63. With this design, with the benefit of coil springs, the device can have a snap back action which may be livelier than a living hinge of the other embodiments. In this case the snap back action allows the user to have a different level of feeling and control than with the device shown in FIG. 1 which has living hinges.

Figure 9:
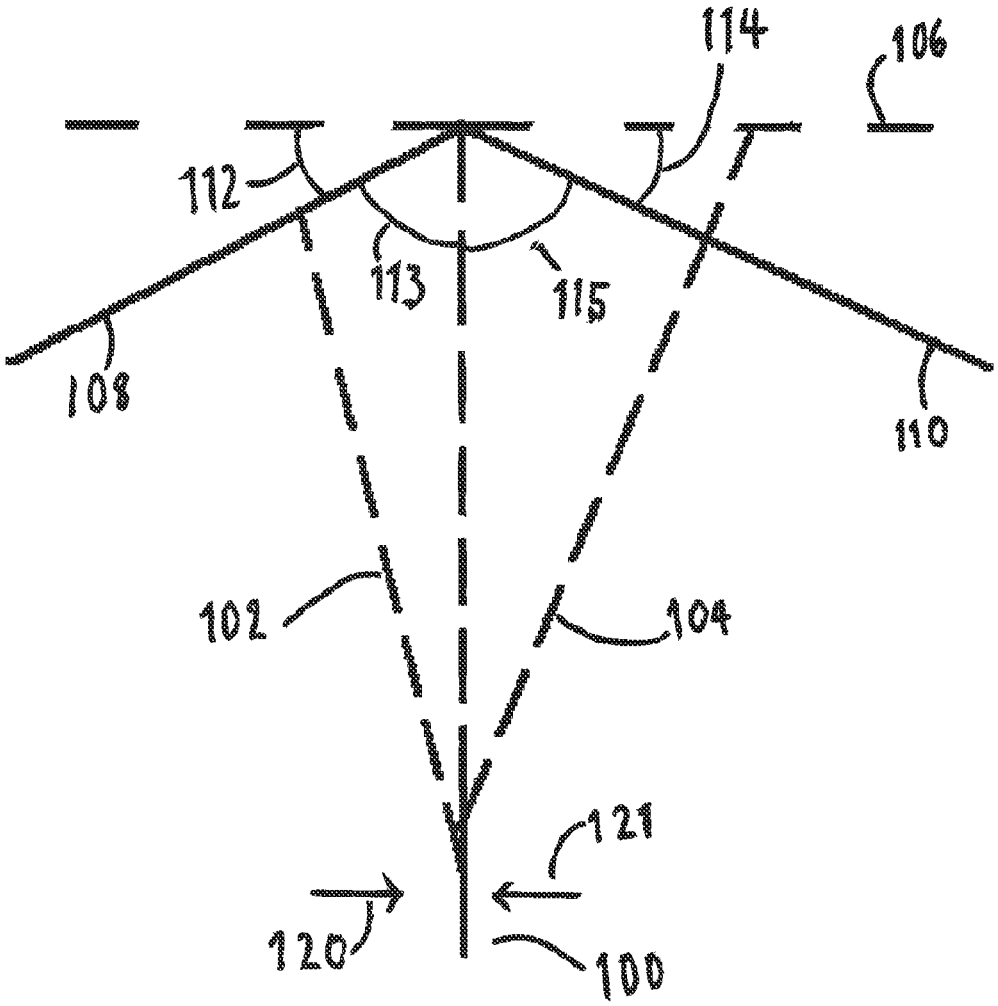
FIG. 9 is a view showing the axes of rotation and longitudinal axes of the limbs.

FIG. 9 is a view of the respective axes of the device wherein there is axis 100 which is the longitudinal axis of first finger 11. Second finger 12 has a longitudinal axis 104 while third finger has a longitudinal axis 102. Second finger 12 has a rotational axis 110 while third finger has a rotational axis 108. As discussed above, rotational axis 110 is transverse or perpendicular to longitudinal axis 104, while rotational axis 108 is transverse or perpendicular to longitudinal axis 102. There is also a transverse axis 106 which is transverse to longitudinal axis 100, this transverse axis 106 shows that axis of rotation 110 and axis of rotation 108 are offset from 90 degrees from longitudinal axis 100. This offset forms an offset angle 112 between rotational axis 108 and transverse axis 106 and an offset angle 114 between rotational axis 110 and transverse axis 106. These offset angles are complementary to acute angles 113 and 115 for respective rotational angles 108 and 110. The offset angles 112 and 114 are set so that second and third limbs 12 and 13 which are latitudinally offset from each other along transverse axis 106 rotate down so that their distal ends, or ends opposite their connection to body 10, are pressed in contact with each other or adjacent to each other when the device is closed or clamped down thereby creating pressure on a food item in at least a direction shown by arrows 120 and 121 to thereby stabilize the food item against movement via these forces. The food item is also clamped between the limbs via the clamping forces of first limb 11 and second and third limbs 112 and 113 respectively, clamping together as shown in FIG. 10.

Figure 10:
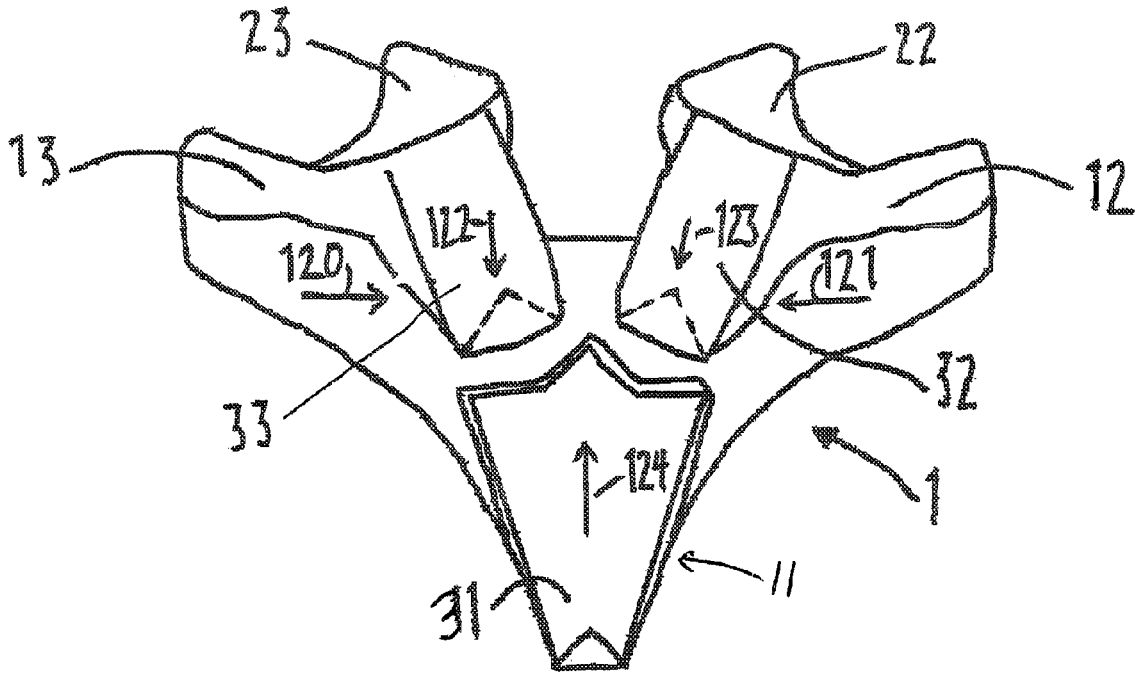
FIG. 10 is a view of the device shown in FIG. 1 in a closed position.

FIG. 10 shows a clamped position of the device shown in FIG. 1. In this case, there is shown second limb 12 and third limb 13 clamped down towards first limb 11 respective channels 22 and 23 for limbs 12 and 13 are also shown. In addition respective teeth 31, 32 and 33 are also shown for respective limbs 11, 12, and 13. Thus, when a user clamps down on second limb 12 and third limb 13 to draw second limb 12 and third limb 13 towards first limb 11, second limb 12 and third limb 13 move towards first limb 11 in a first dimension formed for example by arrows 122, 123, 124, and during this movement, second limb 12 and third limb 13 move towards each other as well in a second dimension shown by arrows 120 and 121.

In this view arrows 120 and 121 show the direction of lateral pressure that is applied when the limbs are clamped down. In addition arrows 122 and 123 show the direction of clamping pressure applied when the device is clamped down by a user's fingers. These arrows of pressure represent the helpful pressure that is applied when a user clamps down on the device. Because there are at least three fingers, this type of lateral pressure in the form of arrows 120 and 121 can be applied due to the offset angled settings of rotational axes 108 and 110. For example arrows 120 and 121 are shown extending substantially perpendicular to arrows 122 and 123 which show the different pressures applied to support food in a usable manner. If pressure was only applied along a single plane or dimension such as in the direction of arrows 122, 123 and 124, then this would result in a clumsy handling of food and an unenjoyable experience for the user. In the case of food such as wings, the wings might become unbalanced and slip out of the grip of the user. Thus with the lateral forces applied, the wings or other types of food such as ribs, steak, corn, chicken fingers, shrimp, etc, can be stabilized in a usable manner.

Essentially in at least one embodiment there is a food handing device comprising at least three limbs including a first limb 11 for receiving a first finger such as a thumb, a second limb 12 for receiving a second finger such as an index finger, and a third limb 13 for receiving a third finger. There is also at least one body section 10 coupled to each of the first limb 11, the second limb 12, and the third limb 13. Coupled to the body section are at least two hinges 52 and 53 for coupling the second limb 12 and the third limb 13 to body section 10, wherein these limbs 12 and 13 are independent of each other. These hinges 52 and 53 can be any type of hinges but comprise a first hinge in the form of a living hinge for allowing second limb 12 to be movable about a first rotational axis 110. There is also a second hinge 53 in the form of a living hinge allowing third limb 13 to be movable about a second rotational axis 108 which extends at a different angle relative to first rotational axis 110. In this case living hinges are hinges that allow bendable movement of two elements formed essentially integral with each other.

In one embodiment second limb 12 has a first end coupled to body section 10 and a second opposite or distal end. Second limb 12 has at least one additional hinge 120 disposed between the first end and the second opposite end, to create an articulating second limb as shown in FIG. 4.

The third limb 13 has a first end coupled to body section 10 and a second opposite end, wherein the third limb 13 has at least one additional hinge 130 disposed between the first end and the second or distal end, to create an articulating third limb 13. Due to the channels formed in these teeth such as channels 21, 22 and 23, these limbs are easily controllable by a user's fingers.

Figure 11:
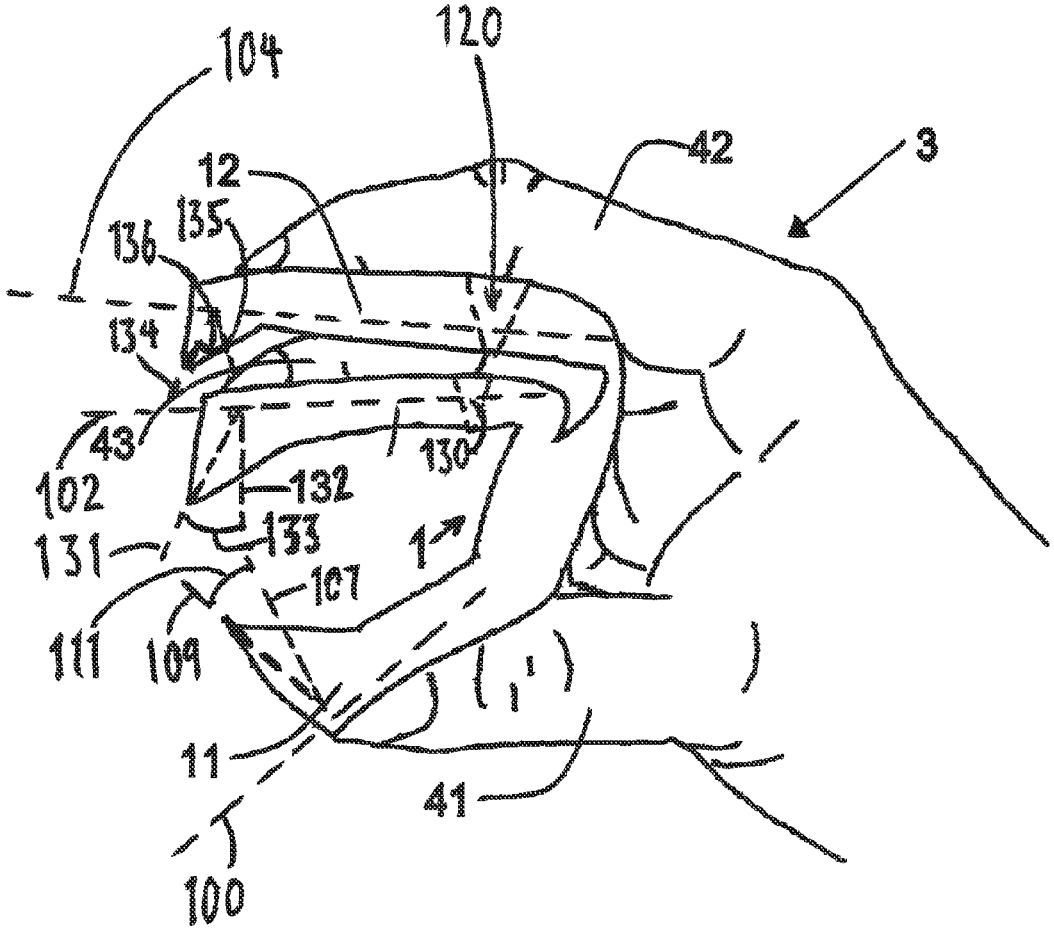
FIG. 11 is a modified view of FIG. 4.

FIG. 11 is a modified view of FIG. 4 which discloses the angles of extension of teeth 31, 32, and 33 relative to their respective limbs. For example, there is shown longitudinal axis 104 of second limb 12 wherein finger 42 which can be in the form of an index finger extends along this longitudinal axis in the channel for these teeth. Tooth 32 extends out from limb 12 along axis 134 which is offset from axis 135 via offset angle 136. Axis 135 is transverse or perpendicular to longitudinal axis 104. Similarly tooth 31 extends out from limb 11 along axis 109 which is offset from axis 107 via offset angle 111. Axis 107 is perpendicular to longitudinal axis 100 which is the longitudinal axis of limb 11. In addition, tooth 33 extends out from limb 13 along axis 131 which is offset from axis 132 via offset angle 133. These offset angles 111, 133 and 135 are such that it allows the extension of these teeth 31, 32, and 33 to extend out away from their respective limbs to allow a clamped down piece of food to be spaced away from a body or limb section of this device. Thus, because of offset angles 111, 133, and 136, the extension axis such as axes 109, 131 and 134 for each respective tooth 31, 32, and 33 intersects a respective longitudinal axis 100, 104, and 102 for a respective limb 11, 12, and 13 at an acute angle such that each tooth 31, 32, and 33 extends out away from each limb 11,12, and 13 to allow a user to grip food in a position away from each limb. Thus, one benefit of these offset extending teeth is that once the piece of food is clamped down upon, the food is spaced away from the body of the device so that a user can easily eat the food.

Accordingly, while only a few embodiments of the present invention have been shown and described, it is obvious that many changes and modifications may be made thereunto without departing from the spirit and scope of the invention.

REFERENCE SYMBOL LIST

1 utensil/device
2 food
3 hand
5 vertical support member
6 horizontal support member
10 body section
11 first limb
12 second limb
13 third limb
14 fourth limb
21 first finger channel
22 second finger channel
23 third finger channel
24 fourth finger channel
31 first tooth
31.1 first tooth point
31.2 first tooth recess
31.3 first tooth second point
32 second tooth
32.1 point
32.2 recess point
32.3 point
33 third tooth
33.1 point
33.2 recess point
33.3 point
34 fourth tooth
34.1 point
34.2 recess point
34.3 point
41 first finger
42 second finger
43 third finger
44 fourth finger
52 second-limb hinge
53 third-limb hinge

62 second limb rotational coupling
63 third limb rotational coupling
72 second limb coil spring
73 third limb coil spring
82.1 second limb channel spring retainer pin
82.2 second limb body spring retainer pin
83.1 third limb channel spring retainer pin
83.2 third limb body spring retainer pin
98 optional reinforcing rib
99 optional reinforcing rib
100 longitudinal axis of first limb
102 longitudinal axis of third limb
104 longitudinal axis of second limb
106 axis transverse to longitudinal axis of first limb
107 axis of extension perpendicular to
108 axis of rotation of third limb
109 axis of extension of first tooth 31
110 axis of rotation of second limb
111 offset angle formed between axis 109 and axis 107
112 offset angle for third limb
114 offset angle for second limb
120 additional hinge for second finger
130 additional hinge for third finger
131 axis of extension of tooth 33
132 axis of extension perpendicular to longitudinal axis
133 offset angle formed between axis 131 and 132
134 axis of extension of tooth
135 axis perpendicular to longitudinal axis 104
136 offset angle formed between axis 134 and axis 135

What is claimed is:

1. A food handling device comprising:

a) at least three limbs comprising:

i) a first limb for receiving a user's first digit, said first limb having an open channel;

ii) a second limb for receiving a user's second digit, said second limb having an open channel;

iii) a third limb for receiving a user's third digit; and b) at least one body section coupled to each of said first limb, said second limb, and said third limb;

c) at least one hinge coupled to said body section, said at least one hinge for allowing at least one of said second limb and said third limb to be movable about a rotational axis wherein said at least one hinge is a living hinge extending along a bend line and configured to spring at least one of said second limb and said third limb away from said first limb wherein at least one open channel of said first limb and at least one open channel of said second limb are open along their longitudinal axis such that when a user's digits are positioned in said open channels of said first limb and said second limb, said user's digits are exposed along said first limb's and said second limb's longitudinal axis.

2. The device as in claim 1, wherein said first limb is disposed opposite said second limb and said third limb, wherein said first limb, said second limb and said third limb are configured so that when a user presses his digits together, which are contacting said first limb, said second limb and said third limb, said first limb, said second limb and said third limb contact each other.

3. The device as in claim 1, wherein said first limb, said second limb and said third limb each further comprise at least one tooth.

4. The device as in claim 3, wherein said first limb is disposed opposite said second limb and said third limb, wherein when said first limb, said second limb, and said third limb are configured so that when a user presses on said first limb, said second limb and said third limb, said at least one tooth from said second limb and at least one tooth of said at third limb contact at least one tooth of said first limb.

5. The device as in claim 4, wherein said first limb has a first end coupled to said body and an opposite end coupled to said at least one tooth and wherein said second limb has a first end coupled to said body via said at least one hinge and an opposite end coupled to said at least one tooth; wherein said third limb has a first end coupled to said body via said at least one hinge and an opposite end coupled to said at least one tooth.

6. The device as in claim 4, wherein said tooth of said first limb comprises at least one concave shaped tooth.

7. The device as in claim 4, wherein each tooth of said first limb, said second limb, and said third limb are each shaped as a concave tooth having at least two points.

8. The device as in claim 1, wherein said open channel of said second limb is configured such that when a user's digit is inserted into said open channel, said user's digit is exposed outside of said open channel, and wherein the device further comprises a living hinge and wherein said second limb and said third limb are coupled to said first limb via said living hinge such that said second limb and said third limb would naturally spring away from said first limb.

9. The device as in claim 1, wherein said third limb has an open channel that is configured such that when a user's digit is inserted into said open channel, said user's digits are exposed outside of said open channel.

10. The device as in claim 1, wherein said first limb-is configured such that when a user's digit is inserted into said open channel, a knuckle of said user's digit is exposed outside of said open channel.

11. The device as in claim 1, wherein said second limb and said third limb are each coupled to said body section via a living hinge.

12. The device as in claim 1, wherein said at least three limbs each comprise a curved open channel.

13. The device as in claim 12, wherein said open channels of said at least three limbs each have at least two sides.

14. The device as in claim 13, wherein said open channels of said at least three limbs each have closed ends.

15. The device as in claim 1, wherein said body section further comprises a plurality of reinforcing ribs.

16. The device as in claim 1, wherein each of said at least three limbs has a first end coupled to said body section and a second distal end, and wherein least one limb has at least one additional hinge comprising a living hinge disposed along said at least one limb between said first end and said second distal end.

17. The food handling device as in claim 1, wherein said body section has a substantially flat back.

18. The food handling device as in claim 1, wherein an open channel of at least one limb extends substantially along a length of the limb.

19. The food handling device as in claim 1, wherein at least one of said second limb and said third limb are coupled to said body section via a single bend point.

20. The food handling device as in claim 1, further comprising at least one tooth, wherein said at least one tooth extends at an angle offset from a longitudinal axis of said at least one limb.

21. The food handling device as in claim 20, wherein said at least one tooth extends at an angle between an axis parallel to a longitudinal extension of said at least one limb, and an angle substantially perpendicular to the longitudinal axis of said at least one limb.

22. A food handling device comprising:

a) at least three limbs comprising:

i) a first limb for receiving a user's first digit, said first limb having an open channel;

ii) a second limb for receiving a user's second digit, said second limb having an open channel;

iii) a third limb for receiving a user's third digit, and b) at least one body section coupled to each of said first limb, said second limb, and said third limb;

c) at least two hinges for coupling said second limb and said third limb to said at least one body section, independent of each other, said at least two hinges comprising:

i) a first hinge for allowing said second limb to be movable about a first rotational axis;

ii) a second hinge allowing said third limb to be movable about a second rotational axis which extends at a different angle relative to said first rotational axis wherein said at least two hinges are configured to spring at least one of said second limb and said third limb away from said first limb wherein at least one open channel of said first limb and at least one open channel of said second limb are open along its longitudinal axis such that a when a user's digits are positioned in the open channel, they are exposed along their longitudinal axis and wherein said first limb, said second limb and said third limb are held by compression of the user's digits against said limbs which tend to flex into the open position.

23. The device as in claim 22, wherein said second limb has a first end coupled to said body section and a second opposite end, and wherein said second limb has at least one additional hinge disposed between said first end and said second opposite end, to create an articulating second limb, wherein said third limb has a first end coupled to said body section and a second opposite end, and wherein said third limb has at least one additional hinge disposed between said first end and said second opposite end, to create an articulating third limb.

24. The device as in claim 23, wherein each extension axis for each tooth intersects a respective longitudinal axis for a respective limb at an acute angle such that each tooth extends out from each limb to allow a user to grip food in a position away from each limb, wherein when a user clamps down on said second limb and said third limb to draw said second limb and said third limb towards said first limb, said second limb and said third limb move towards said first limb in a first dimension, and said second limb and said third limb move towards each other as well in a second dimension.

25. The device as in claim 22, wherein each limb has an open channel which extends along a longitudinal axis of each limb, and wherein said open channels are for receiving a digit of a user and wherein each limb has at least one tooth, and wherein each tooth extends along an extension axis and wherein at least one open channel is configured to be open such that it allows a user's digit to be exposed while it is inserted into the open channel.

26. A food handling device comprising:

a) at least three limbs comprising:

i) a first limb for receiving a user's first digit said first limb having an open channel;

ii) a second limb for receiving a user's second digit, said second limb having an open channel;

iii) a third limb for receiving a user's third digit, and b) at least two hinges for coupling said second limb and said third limb to said first limb, independent of each other, said at least two hinges comprising:

i) a first hinge for allowing said second limb to be movable about a first rotational axis;

ii) a second hinge allowing said third limb to be movable about a second rotational axis which extends at a different angle relative to said first rotational axis wherein said at least two hinges are configured to spring at least one of said second limb and said third limb away from said first limb wherein at least one open channel of said first limb and at least one open channel of said second limb is open along its longitudinal axis such that a when a user's limbs are positioned in the open channel, they are exposed along their longitudinal axis and wherein said first limb, said second limb and said third limb are held by compression of the user's limbs against said limbs which tend to flex into the open position.

* * * * *